US005806731A

United States Patent [19]

Mark

[11] Patent Number: 5,806,731

[45] Date of Patent: Sep. 15, 1998

[54] BELT ATTACHMENT DEVICE FOR CARRYING HANDGUNS

[76] Inventor: Edward H. Mark, U.S. 31 N., Niles, Mich. 49120

[21] Appl. No.: 818,532

[22] Filed: Mar. 14, 1997

[51] Int. Cl.[6] ..... F41C 33/02

[52] U.S. Cl. ..... 224/250; 224/674; 224/192; 224/911; 24/182; 2/300

[58] Field of Search ..... 224/911, 660, 224/250, 665, 671, 672, 674, 675, 676, 242, 243, 249, 251; 24/182; 2/321, 322, 312, 300

[56] References Cited

U.S. PATENT DOCUMENTS

| | | | |
|---|---|---|---|
| 2,434,380 | 1/1948 | Williams | 224/911 |
| 4,044,929 | 8/1977 | Caruso | 224/660 |
| 4,544,089 | 10/1985 | Tabler | 224/911 |

FOREIGN PATENT DOCUMENTS

| | | | |
|---|---|---|---|
| 243932 | 5/1960 | Australia | 2/321 |
| 1190195 | 7/1985 | Canada | 224/911 |

*Primary Examiner*—Linda J. Sholl
*Attorney, Agent, or Firm*—Baker & Daniels

[57] ABSTRACT

A handgun carrying device which is for attachment to a standard garment belt and which includes a strap forming a retaining loop or holster with the belt to accept the gun. The strap has a fixed loop attached at one end and carries a cinch loop which is slidably adjustable along the length of the strap. The belt is inserted through the loops so that the strap is worn on the inside of the belt. The gun is inserted between the strap and belt, and the cinch loop is adjusted toward the gun to constrict the strap and belt around the gun, thereby forming a holster.

8 Claims, 2 Drawing Sheets

BELT ATTACHMENT DEVICE FOR CARRYING HANDGUNS

The present invention relates to a device for attachment to a standard garment belt which forms an adjustable retaining loop or holster for carrying objects such as a handgun.

BACKGROUND OF THE INVENTION

It is desirable to tote objects, such as handguns, in a manner that provides quick and easy and access to the objects for use. Heretofore, devices such as holsters, many of which are attachable to a standard belt, have enabled wearers to carry such objects. These conventional carrying devices, however, are often bulky and unattractive. Accordingly, during times throughout the day that the wearer decides to temporarily remove the handgun, the wearer may also desire to remove the carrying device because it is obtrusive or otherwise easily detectable by others. Also, because these devices are frequently designed to hold specific objects of a certain size in a certain orientation, they lack adjustability. As such, there exists a need for an unobtrusive, adjustable device for carrying objects such as handguns.

SUMMARY OF THE INVENTION

The present invention provides a device for attachment to a standard belt which forms an adjustable retaining loop or holster with the belt to secure objects, such as handguns, to the body of the wearer. The device includes a strap with a fixed loop at one end and a cinch loop encircling the strap which is slidably adjustable along its length. A belt is inserted through both the fixed loop and the cinch loop with the strap being held against the inside surface of the belt. As such, the device is substantially concealed behind the belt. Only the portion of each loop overlying the belt is visible to the observer. Furthermore, since the strap and loops may be constructed of material which matches or closely resembles the belt, even the exposed loops may be difficult to distinguish from the belt. In operation, the handgun to be held is then inserted between the belt and the strap, and the cinch loop is slid toward the handgun to tighten the strap around the object, thereby holding the gun securely in place at any desired angle relative to the belt. Additionally, since the device can be attached at any location along the belt's length, the handgun can be carried, for example, at either side of the wearer's waist or at the wearer's back.

Accordingly, it is an object of this invention to provide a device for carrying objects which is attachable to a standard belt.

Another object of the present invention is to provide a belt attachment device for carrying handguns which is unobtrusive and substantially concealed behind the belt.

Yet another object of the invention is to provide a belt attachment device for carrying handguns which is adjustable to retain handguns of various sizes in various orientations and locations relative to the wearer's belt.

BRIEF DESCRIPTION OF THE DRAWINGS

The above-mentioned and other objects of the present invention, and the manner of attaining them, will become more apparent and the invention itself will be better understood by reference to the following description of the invention taken in conjunction with the accompanying drawings, wherein.

DESCRIPTION OF THE INVENTION

The preferred embodiment disclosed below is not intended to be exhaustive or to limit the invention to the precise form disclosed. Rather, the embodiment is chosen and described so that others skilled in the art may utilize its teachings.

Figure 1:
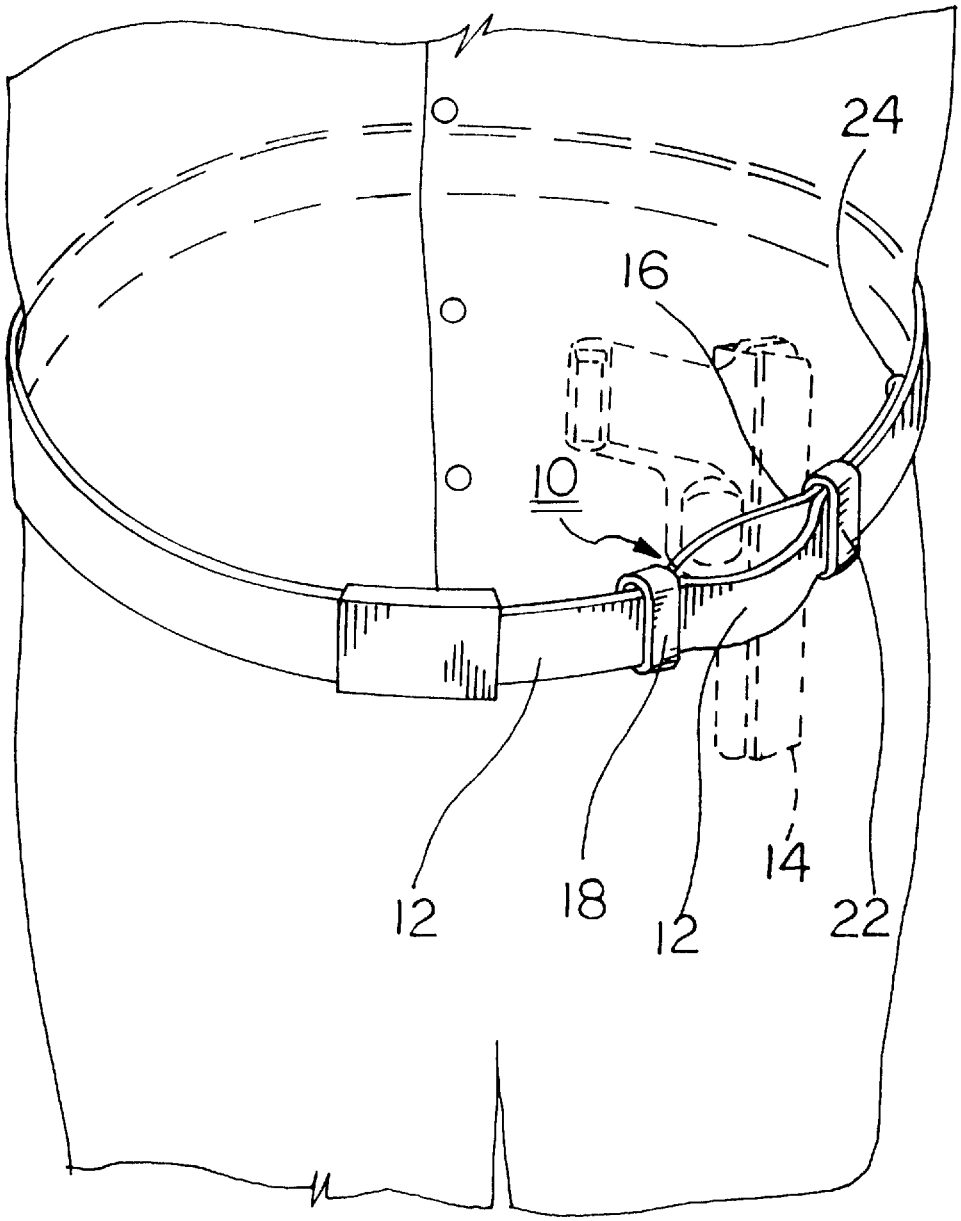
FIG. 1 is a perspective view of a carrying device according to the present invention shown attached to a belt with a handgun shown in broken lines carried thereby.
Figure 2:
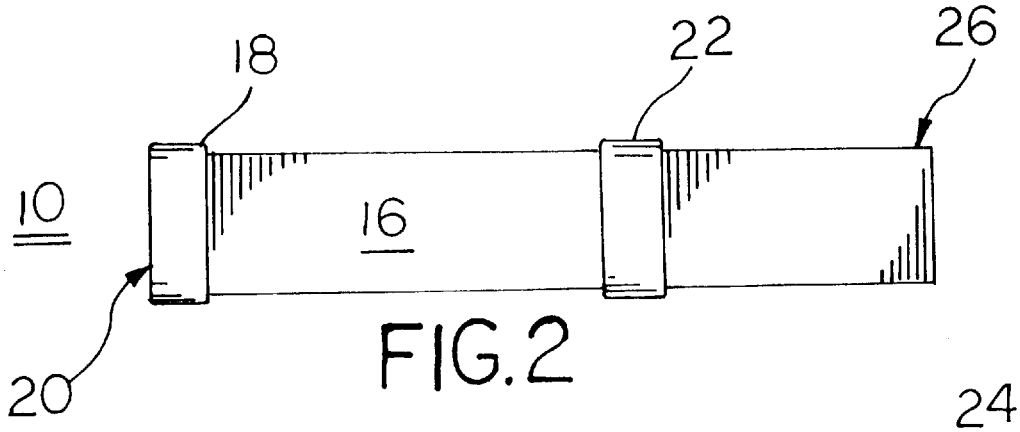
FIG. 2 is a side elevational view of the carrying device.
Figure 3:
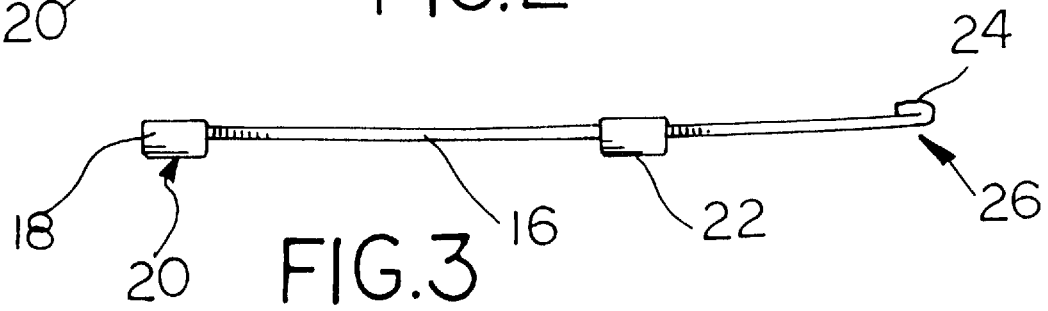
FIG. 3 is a top plan view of the carrying device.

FIG. 1 shows the carrying device 10 of the present invention attached to a standard belt 12 and retaining a handgun 14 (shown in broken lines). Carrying device 10 includes a strap 16 having a fixed loop or band 18 attached at one end 20. The fixed loop or band 18 extends across the width of the strap 16 in substantially perpendicular relationship with respect to the length thereto. A continuous cinch loop 22 freely encircles strap 16 and is slidable along its length. A stop 24 is provided at the opposite end 26 of strap 16 to prevent cinch loop 22 from sliding off of the strap. Stop 24 may be formed in a variety of shapes and configurations, for example by return bending the strap at its end 26 and sewing or gluing the return bent end to the strap. The strap may be formed from a variety of materials, preferably leather.

Mode of Operation

Figure 4:
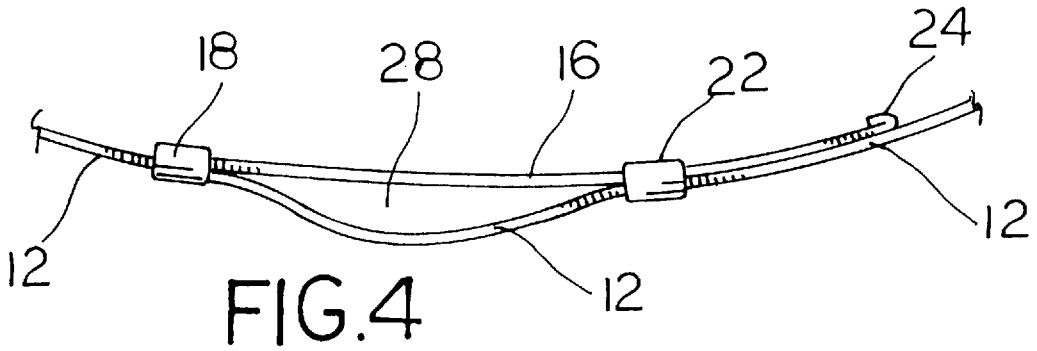
FIG. 4 is a top plan view of the carrying device shown attached to a belt and adjusted for receipt of a handgun.
Figure 5:
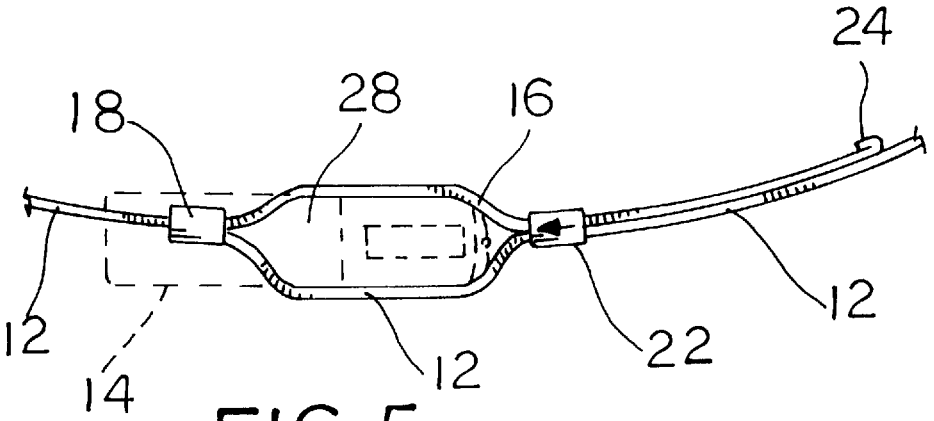
FIG. 5 is a top plan view similar to FIG. 4 in which a handgun shown in broken lines is secured within the carrying device.

Carrying device 10 is attached to belt 12 by inserting the belt through fixed loop 18 and cinch loop 22 with the strap 16 being located at the inside surface of the belt, between the belt and the wearer's body. The belt may be inserted first through either fixed loop 18 or cinch loop 22. The carrying device 10 so secured to belt 12 can then be slid along the belt and positioned at a desired location about the wearer's waist. As best shown in FIG. 4, strap 16 between loops 22 and 18 is separated from belt 12 to form a holster or retaining loop 28. A handgun 14 is then inserted barrel first into retaining loop 28 behind belt 12 and along side the body of the belt wearer. The handgun may be inserted so that the butt of the gun faces forward or backward. Handgun 14 is then tightly secured between belt 12 and strap 16 by sliding cinch loop 22 toward the gun, thereby reducing the size of retaining loop 28 and causing strap 16 and belt 12 to constrict around the gun as shown in FIG. 5.

As should be apparent from the above description, fixed loop 18 and cinch loop 22 are advantageously sized to fit snugly around belt 12 so that device 10 remains substantially in its original position about the waist of the belt wearer during use. Also, strap 16 may be produced in various widths to approximate standard belt widths. When carrying device 10 is attached to a belt having a similar width, strap 16 is substantially concealed between the belt and the wearer's body, thereby providing an unobtrusive carrying device when either in use or not in use. Thus, the wearer can wear device 10 continuously throughout the day, even when the wearer temporarily removes the handgun.

Additionally, since device 10 may be worn at any location around the waist of the wearer, with cinch loop 22 forward or back, and the handgun 14 may be inserted butt forward or back, the present invention permits left or right hand drawing of the handgun using either a cross draw or straight draw, depending upon the preference of the wearer. Also, since strap 16 constricts around handgun 14 and conforms to the portion of the gun located between belt 12 and strap 16, the handgun may be secured to the wearer at a variety of angles relative to vertical. This not only provides a more comfortable draw, the wearer can improve the comfort of carrying the gun by adjusting its angle when, for example, the wearer assumes a sitting position.

While this invention has been described as having exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for retaining a handgun comprising:

a garment belt having inner and outer sides;

a substantially flat elongated strap having a central portion and two ends, one of said ends being attached to said belt, the other of said ends being disposed adjacent said inner side of said belt;

an adjacent member slidably attached to said strap and said belt, said central portion of the strap being bendable away from said inner side of said belt between said one end and said adjustment member to define an opening between said strap and said belt for receiving a handgun, the size of said opening being adjustable by movement of one of said one end and said adjustment member toward the other;

a stop member attached to said strap adjacent said other end, said stop member constituting means for preventing said adjustment member from sliding off of said strap; and a fixed band attached to said one end of the strap, said fixed band forming a loop receiving said belt to thereby attach said one end to the belt.

2. A device according to claim 1 wherein said fixed band extends across the width of said strap in substantially perpendicular relationship to the length of said central portion.

3. A device for retaining a handgun comprising:

a garment belt;

an elongated strap having a first end adapted for slidable attachment to the belt; and an adjustment member extending about and slidably attached to said strap, said adjustment member adapted slidably attached to the belt, said strap having a central portion between said first end and said adjustment member, said central portion being bendable away from the belt when said one end and said adjustment member are slidably attached to the belt to define an opening for receiving a handgun, the size of said opening being adjustable by movement of one of said one end and said adjustment member toward the other.

4. A device according to claim 3 wherein said strap further includes a second end and a stop member attached to said strap adjacent said second end to prevent said adjustment member from sliding off of said strip.

5. A device according to claim 3 further comprising a fixed band attached to said first end of the strap, said fixed band forming a loop adapted to receive the belt to permit said slidable adjustment of said one end.

6. A device according to claim 5 wherein said fixed band extends across the width of said strap in substantially perpendicular relationship to the length of said central portion.

7. A device according to claim 6 wherein said strap is substantially the same width as the belt.

8. A device according to claim 3 wherein said adjustment member is a continuous band encircling said strap.

* * * * *